US008186861B2

(12) United States Patent
Kagiyama

(10) Patent No.: US 8,186,861 B2
(45) Date of Patent: May 29, 2012

(54) VEHICULAR HEADLAMP

(75) Inventor: Shinji Kagiyama, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 330 days.

(21) Appl. No.: 12/534,588

(22) Filed: Aug. 3, 2009

(65) Prior Publication Data

US 2010/0027283 A1 Feb. 4, 2010

(30) Foreign Application Priority Data

Aug. 4, 2008 (JP) ..... 2008-200423

(51) Int. Cl.
*F21V 7/00* (2006.01)

(52) U.S. Cl. ..... 362/516; 362/539; 362/297

(58) Field of Classification Search ..... 362/512, 362/516, 518, 538–539, 297
See application file for complete search history.

(56) References Cited

U.S. PATENT DOCUMENTS 6,848,814 B2 * 2/2005 Watanabe et al. ..... 362/465
6,857,768 B2 * 2/2005 Watanabe et al. ..... 362/512
2005/0063192 A1 * 3/2005 Tatara et al. ..... 362/512

FOREIGN PATENT DOCUMENTS

JP 2006-079984 A 3/2006

OTHER PUBLICATIONS

English abstract of JP2006079984 published Mar. 23, 2006, esp@cenet database, 1 page.

* cited by examiner

*Primary Examiner* — Robert May
(74) *Attorney, Agent, or Firm* — Osha • Liang LLP

(57) ABSTRACT

Each of a pair of lower reflection areas, which are located on both left and right sides of an optical axis in a lower end portion of a reflective surface of a reflector, respectively, is formed so as to converge light from a light source at a position located forward of a rear side focal point of a projection lens in a horizontal direction, and on the same lateral side as that of each of the lower reflection areas with respect to the optical axis. Thus, the pair of light ray bundles are emitted from the projection lens, whereby a pair of additional light distribution patterns are formed on both sides of a lateral direction central portion in an upper area of a high-beam distribution pattern, respectively. The upper area of the high-beam distribution pattern is thus made bright widely in a lateral direction.

16 Claims, 4 Drawing Sheets

VEHICULAR HEADLAMP

BACKGROUND OF INVENTION

1. Field of the Invention

The present invention relates to a so-called projector-type vehicular headlamp, and, more particularly, to a vehicular headlamp having a movable shade.

2. Related Art

In general, a projector-type vehicular headlamp is constructed such that a projection lens is disposed on an optical axis which extends in a vehicular longitudinal direction, and a light source is disposed rearward of a rear side focal point of the projection lens, so that light from the light source is reflected by a reflector towards the optical axis. In order to form a low-beam distribution pattern by the projector-type vehicular headlamp, the reflected light from the reflector is partially blocked by a shade which is disposed such that an upper end edge thereof is positioned in the proximity of the optical axis near the rear side focal point of the projection lens, whereby a predetermined cut-off line is formed at an upper end portion of a low-beam distribution pattern.

"Patent Document 1" describes a projector-type vehicular headlamp having, as the shade, a movable shade which is constructed to be movable between a light-shielding position where the upper end edge of the shade is positioned in the proximity of the optical axis near the rear side focal point, and a light-shielding moderating position where the amount of the reflected light from the reflector to be blocked is reduced as compared to the light-shielding position.

[Patent Document 1] Japanese Patent Application Laid-Open (Kokai) No. 2006-79984

SUMMARY OF INVENTION

In the vehicular headlamp described in "Patent Document 1," because a high-beam distribution pattern can be formed by moving the movable shade to the light-shielding moderating position, a single lamp can be used both for a low beam and a high beam.

However, in the case where the light source of such a projector-type vehicular headlamp is constructed as a line segment light source which extends generally coaxially with the optical axis, an inverted projection image thereof is formed as an image radially extending on an imaginary vertical screen located ahead of a vehicle.

Thus, if light is condensed in order to increase the central luminous intensity when forming a high-beam distribution pattern, an upper area of the high-beam distribution pattern can be made sufficiently bright in its lateral direction central portion, but becomes dark on both sides thereof, thereby causing a problem that forward visibility cannot be improved.

One or more embodiments of the present invention provide a projector-type vehicular headlamp having a movable shade, which is capable of improving forward visibility with a high beam.

One or more embodiments of the present invention devise a reflective surface of a reflector.

More specifically, a vehicular headlamp according to one or more embodiments of the present invention includes: a projection lens disposed on an optical axis extending in a vehicular longitudinal direction; a light source disposed rearward of a rear side focal point of the projection lens; a reflector for reflecting light from the light source forward towards the optical axis; a movable shade constructed so that the movable shade partially blocks the reflected light from the reflector; and an actuator for moving the movable shade between a light-shielding position where an upper end edge of the movable shade is positioned in a proximity of the optical axis near the rear side focal point of the projection lens, and a light-shielding moderating position where an amount of the reflected light from the reflector to be blocked is reduced as compared to the light-shielding position. The vehicular headlamp is characterized in that the light source is constructed as a line segment light source extending generally coaxially with the optical axis, a pair of lower reflection areas are formed in a lower end portion of a reflective surface of the reflector so as to be positioned on both left and right sides of the optical axis, respectively, and each of the pair of left and right lower reflection areas is formed so as to converge the light from the light source at a position located forward of the rear side focal point of the projection lens in a horizontal direction, and on the same lateral side as that of the each lower reflection area with respect to the optical axis.

The type of the "light source" is not specifically limited as long as the light source is constructed as a line segment light source extending generally coaxially with the optical axis. For example, a light-emitting portion of a discharge bulb, a filament of a halogen bulb, or the like may be employed as the light source.

A specific position of formation, a specific surface configuration or a specific outer configuration, or the like, of the "lower reflection areas" are not specifically limited as long as each lower reflection area is formed so as to converge the light from the light source at a position located forward of the rear side focal point of the projection lens in the horizontal direction, and on the same lateral side as that of the each lower reflection area with respect to the optical axis.

As shown in the above structure, the vehicular headlamp according to one or more embodiments of the present invention is constructed as a projector-type vehicular headlamp having a movable shade, and can form a high-beam distribution pattern when the movable shade is located in the light-shielding moderating position. In this case, each of the pair of lower reflection areas, which are located on the left and right sides of the optical axis in the lower end portion of the reflective surface of the reflector, respectively, is formed so as to converge the light from the light source at a position located forward of the rear side focal point of the projection lens in the horizontal direction, and on the same lateral side as that of the lower reflection area with respect to the optical axis. Thus, the following effects can be obtained.

In the vehicular headlamp of one or more embodiments of the present invention, the light source is constructed as a line segment light source extending generally coaxially with the optical axis. Thus, an inverted projection image thereof is formed as an image radially extending on an imaginary vertical screen located ahead of a vehicle. Accordingly, if light is condensed in order to increase the central luminous intensity when forming a high-beam distribution pattern, an upper area of the high-beam distribution pattern becomes sufficiently bright in its lateral direction central portion, but becomes dark on both sides thereof, in the case where the pair of left and right lower reflection areas are not formed. Thus, forward visibility cannot be improved.

In the vehicular headlamp of one or more embodiments of the present invention, on the other hand, the light from the light source, reflected from each of the pair of left and right lower reflection areas formed in the reflective surface of the reflector, converges at a position located forward of the rear side focal point of the projection lens in the horizontal direction, and on the same lateral side as that of the lower reflection area with respect to the optical axis. Thus, the pair of left and right light ray bundles are emitted from the projection lens, whereby a pair of left and right additional light distribution patterns are formed on both sides of the lateral direction central portion in the upper area of the high-beam distribution pattern, respectively. As a result, the upper area of the high-beam distribution pattern becomes bright widely in the lateral direction, whereby forward visibility is improved.

Thus, according to one or more embodiments of the present invention, forward visibility with a high beam of a projector-type vehicular headlamp having a movable shade can be improved.

Moreover, the light from the light source, reflected from each of the pair of left and right lower reflection areas, converges at a position located forward of the rear side focal point of the projection lens in the horizontal direction, and on the same lateral side as that of the lower reflection area with respect to the optical axis. Thus, most of the pair of left and right light ray bundles can be directed to the projection lens, even thought the pair of left and right lower reflection areas are located in the lower end portion of the reflective surface.

In the above structure, when each of the pair of left and right lower reflection areas is formed so as to cause the light from the light source to pass through a rear side focal plane of the projection lens (i.e., a focal plane including the rear side focal point of the projection lens) at a position near under the optical axis, the pair of left and right additional light distribution patterns can be made to substantially match the position of the upper area of the high-beam distribution pattern in a vertical direction. Thus, the effect of making the upper area of the high-beam distribution pattern bright widely in the lateral direction can be improved.

In the above structure, when a lower end edge of a reflection area other than the pair of left and right lower reflection areas in the reflective surface of the reflector is formed so as to extend in the horizontal direction, manufacturing of the reflector is facilitated, whereby the accuracy of the reflective surface of the reflector can be improved.

Other aspects and advantages of the invention will be apparent from the following description, the drawings and the claims.

DETAILED DESCRIPTION

Hereafter, embodiments of the present invention will be described with reference to accompanying drawings.

Figure 1:
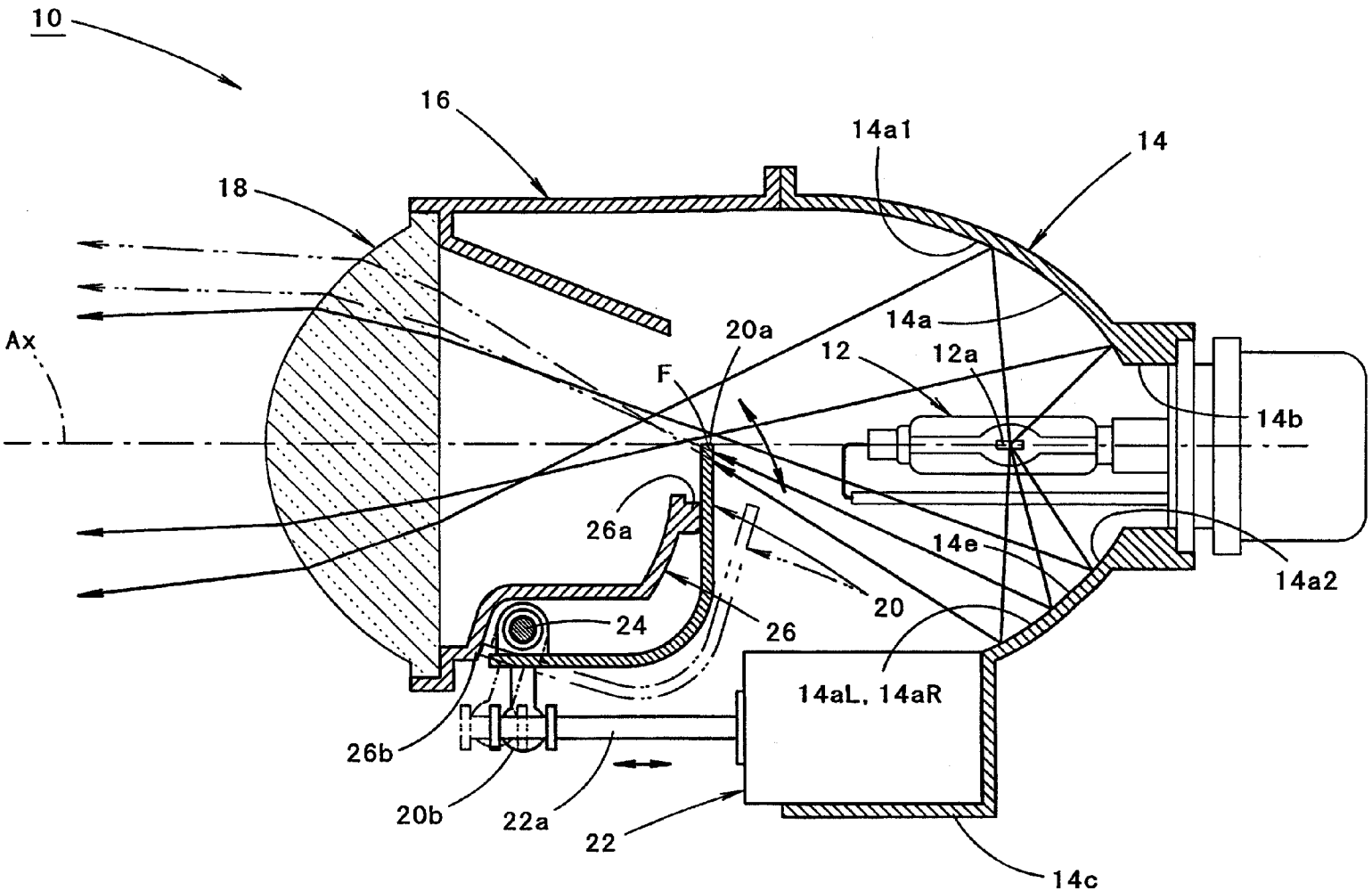
FIG. 1 is a lateral cross-sectional view showing a vehicular headlamp according to an embodiment of the present invention.
Figure 2:
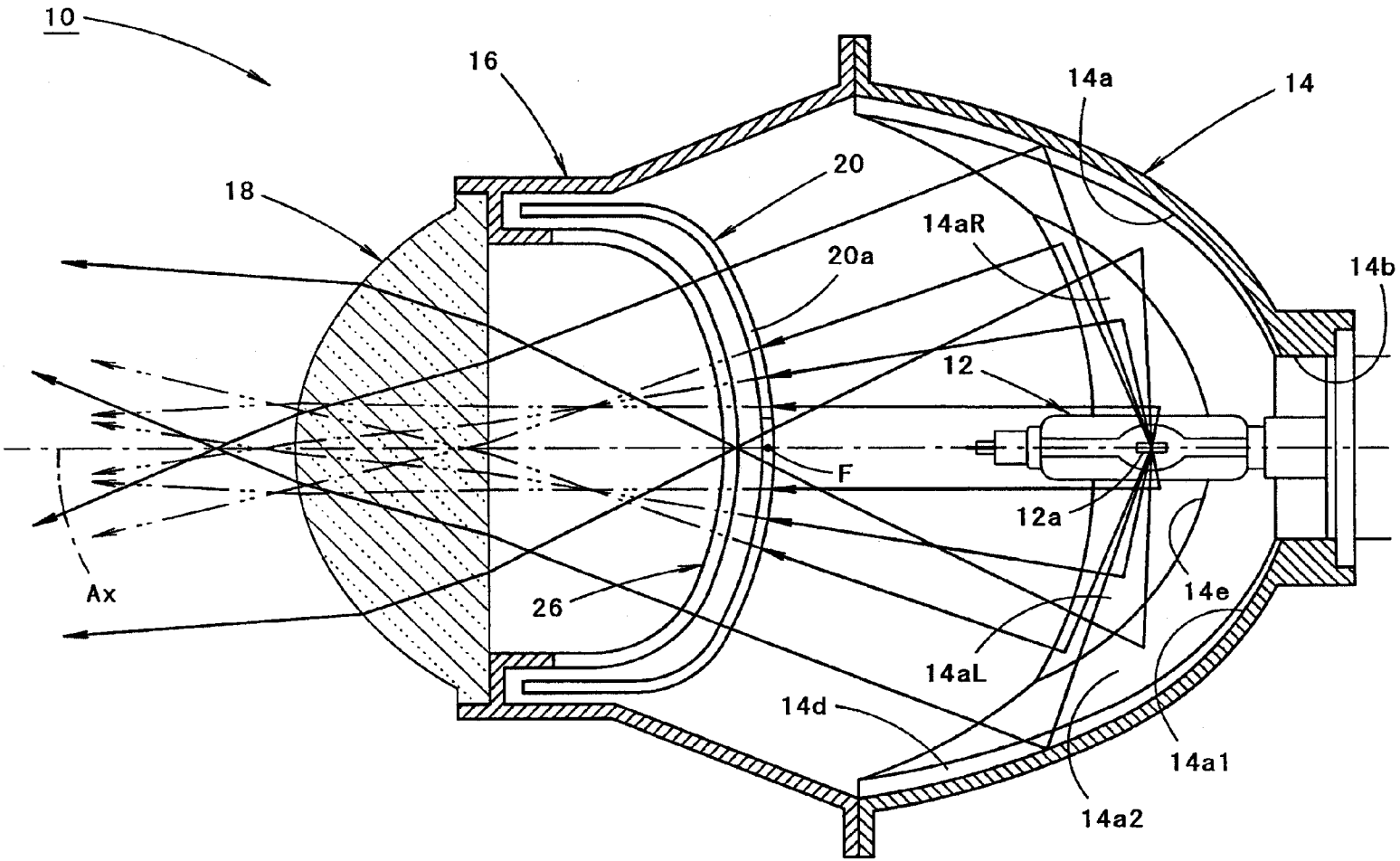
FIG. 2 is a plane cross-sectional view showing the vehicular headlamp.

FIG. 1 is a lateral cross-sectional view showing a vehicular headlamp 10 according to an embodiment of the present invention, and FIG. 2 is a plane cross-sectional view thereof.

As shown in these figures, the vehicular headlamp 10 is constructed as a projector-type lamp unit, and is used in a built-in state in a lamp body or the like, which is not shown.

The vehicular headlamp 10 includes a light source bulb 12, a reflector 14, a holder 16, a projection lens 18, a movable shade 20, and an actuator 22, and has an optical axis Ax extending in a vehicular longitudinal direction. It should be noted that the vehicular headlamp 10 is disposed such that the optical axis Ax extends downward by about 0.5 to 0.6° with respect to the vehicular longitudinal direction at the stage of completion of aiming adjustment.

The projection lens 18 is formed by a planoconvex aspherical lens having a front surface formed as a convex surface, and a rear surface formed as a plane surface, and is disposed on the optical axis Ax. Moreover, the projection lens 18 projects a light source image, which is formed on a rear side focal plane (i.e., a focal plane including a rear side focal point F of the projection lens 18), as an inverted image on a vertical imaginary screen disposed ahead of the lamp.

The light source bulb 12 is a discharge bulb, such as a metal halide bulb, having a discharging light source as a light source 12*a*, and is fixedly inserted from the rear side into an opening 14*b* formed in a rear top portion of the reflector 14. The light source 12*a* of the light source bulb 12 is constructed as a line segment light source extending generally coaxially with the optical axis Ax, and is disposed rearward of the rear side focal point F of the projection lens 18.

The reflector 14 has a reflective surface 14*a* that reflects light from the light source 12*a* in a forward direction towards the optical axis Ax. The cross-sectional shape of the reflective surface 14*a* along a plane including the optical axis Ax is set to a generally ellipsoidal shape, and the eccentricity thereof is set so as to gradually increase from a vertical cross section toward a horizontal cross section. Thus, light from the light source 12*a*, which is reflected on the reflective surface 14*a*, is generally converged in the proximity of the rear side focal point F in the vertical cross section, and the convergence position thereof is displaced to the front of the rear side focal point F in the horizontal cross section. Note that a specific structure of the reflective surface 14*a* will be described in detail below.

The holder 16 is formed so as to extend in a generally cylindrical shape forward from a front end opening of the reflector 14. The holder 16 fixedly supports the reflector 14 at its rear end, and fixedly supports the projection lens 18 at its front end. The holder 16 is notched in its lower region.

The movable shade 20 is provided so as to be located in a generally lower half portion of the inner space of the holder 16, and a lower end of the movable shape 20 is pivotally supported by the holder 16 via a pivot pin 24 extending in a lateral direction. Thus, this movable shade 20 can take a light-shielding position shown by solid line in FIG. 1, and a light-shielding moderating position shown by two-dotted broken line in FIG. 1, which is pivoted rearward by a predetermined angle from the light-shielding position. An upper end edge 20*a* of the movable shade 20 is formed laterally asymmetrically, and extends in a horizontal direction in a generally circular shape along the rear side focal plane of the projection lens 18 when the movable shade 20 is in the light-shielding position.

The movable shade 20 is disposed so that its upper end edge 20*a* extends through the rear side focal point F of the projection lens 18, when the movable shade 20 is in the light-shielding position, thereby partially blocking reflected light from the reflective surface 14*a* of the reflector 14 to remove most of upward directed light emitted forward from the projection lens 18. On the other hand, when the movable shade 20 moves from the light-shielding position to the light-shielding moderating position, the upper end edge 20*a* is displaced in an obliquely downward direction towards the rear so as to reduce the amount of reflected light from the reflective surface 14*a* to be blocked. In the present embodiment, the amount of reflected light from the reflective surface 14*a* to be blocked is set to substantially zero in the light-shielding moderating position.

The actuator 22 is constructed by a solenoid which has a plunger 22*a* extending in the longitudinal direction, and is fixed to a fitting portion 14*c* formed at a lower end portion of the reflector 14. A tip portion of the plunger 22*a* of the actuator 22 engages with a stay 20*b* that is formed so as to protrude downward from the movable shade 20, whereby longitudinal reciprocating movement of the plunger 20*a* is transmitted as pivot movement of the movable shade 20. Moreover, when a beam switching switch, which is not shown, is operated, this actuator 22 is driven to move the plunger 22*a* in the longitudinal direction, thereby moving the movable shade 20 between the light-shielding position and the light-shielding moderating position.

In front of the movable shade 20, a fixed shade 26 is formed integrally with the holder 16 so as to prevent stray light reflected by the reflector 14 from being incident on the projection lens 18. The fixed shade 26 is formed with a positioning contact portion 26*a* for fixing the movable shade 20 to the light-shielding position by contacting the movable shade 20 when the movable shade 20 is moved to the light-shielding position, and a positioning contact portion 26*b* for fixing the movable shade 20 to the light-shielding moderating position by contacting the movable shade 20 when the movable shade 20 is moved to the light-shielding moderating position.

Figure 3:
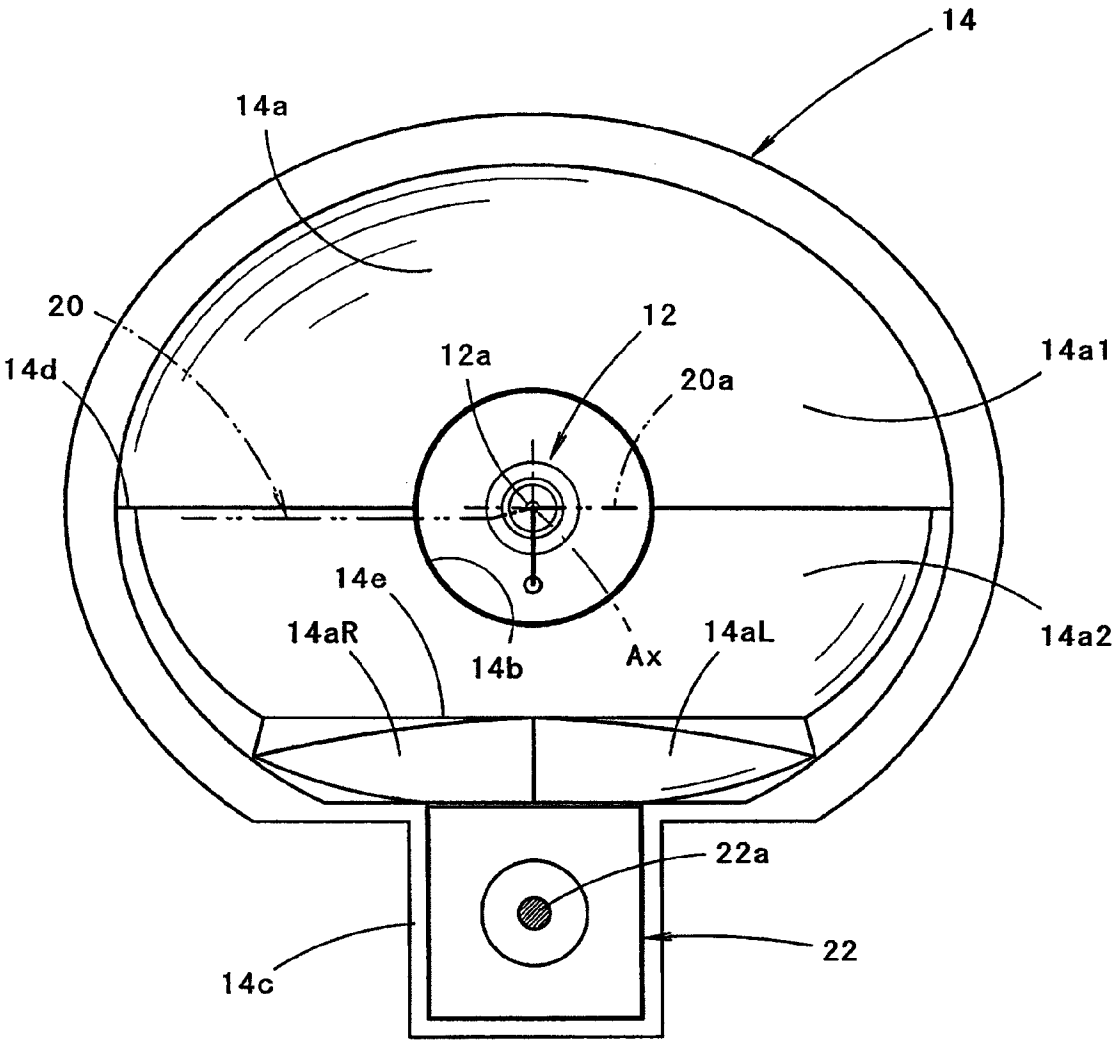
FIG. 3 is a front view showing a reflector of the vehicular headlamp together with a light source bulb.

FIG. 3 is a front view showing the reflector 14 together with the light source bulb 12.

As shown also in FIG. 3, the reflective surface 14*a* of the reflector 14 is formed by a first reflection area 14*a*1 located above a horizontal plane including the optical axis Ax, a second reflection area 14*a*2 located under the horizontal plane including the optical axis Ax, and a pair of left and right lower reflection areas 14*a*L, 14*a*R located under the reflection area 14*a*2.

The first reflection area 14*a*1 is formed mainly in order to form a light distribution pattern having a large lateral diffusion angle which is suitable for a low-beam distribution pattern. Thus, in the first reflection area 14*a*1, the deflection angle of the reflected light of the light source 12*a* towards the optical axis Ax in a horizontal cross section is set to a relatively small value.

On the other hand, the second reflection area 14*a*2 is formed mainly in order to increase the central luminous intensity of a high-beam distribution pattern. Thus, in the second reflection area 14*a*2, the deflection angle of the reflected light of the light source 12*a* towards the optical axis Ax in a horizontal cross section is set to a relatively large value.

Thus, an upward stepped portion 14*d* is formed along a horizontal plane including the optical axis Ax between the first reflection area 14*a*1 and the second reflection area 14*a*2.

A lower end edge 14*e* of the second reflection area 14*a*2 is formed so as to extend in the horizontal direction.

The pair of left and right lower reflection areas 14*a*L, 14*a*R are formed with a laterally symmetrical arrangement and in a laterally symmetrical shape with respect to a vertical plane including the optical axis Ax.

The left lower reflection area 14*a*L is formed so as to converge light from the light source 12*a* at a position located forward of the rear side focal point F of the projection lens 18 in the horizontal direction, and on the left side of the optical axis Ax. On the other hand, the right lower reflection area 14*a*R is formed so as to converge light from the light source 12*a* at a position located forward of the rear side focal point F of the projection lens 18 in the horizontal direction, and on the right side of the optical axis Ax.

Moreover, each of the pair of left and right lower reflection areas 14*a*L, 14*a*R is formed so as to cause light from the light source 12*a* to pass through the rear side focal plane of the projection lens 18 at a position closely under the optical axis 18. Thus, most of reflected light from each of the pair of left and right lower reflection areas 14*a*L, 14*a*R is blocked by the movable shade 20 located in the light-shielding position.

Figure 4A:
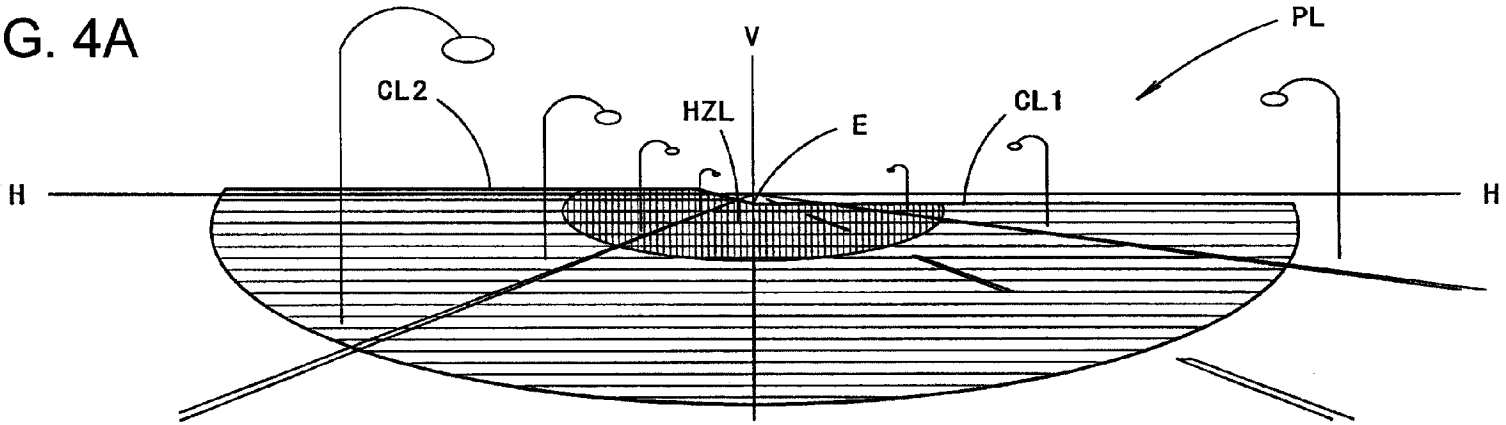
FIG. 4 shows diagrams perspectively showing light distribution patterns which are formed on an imaginary vertical screen disposed at a position 25 meters ahead of the headlamp, by light radiated forward from the vehicular headlamp.
Figure 4B:
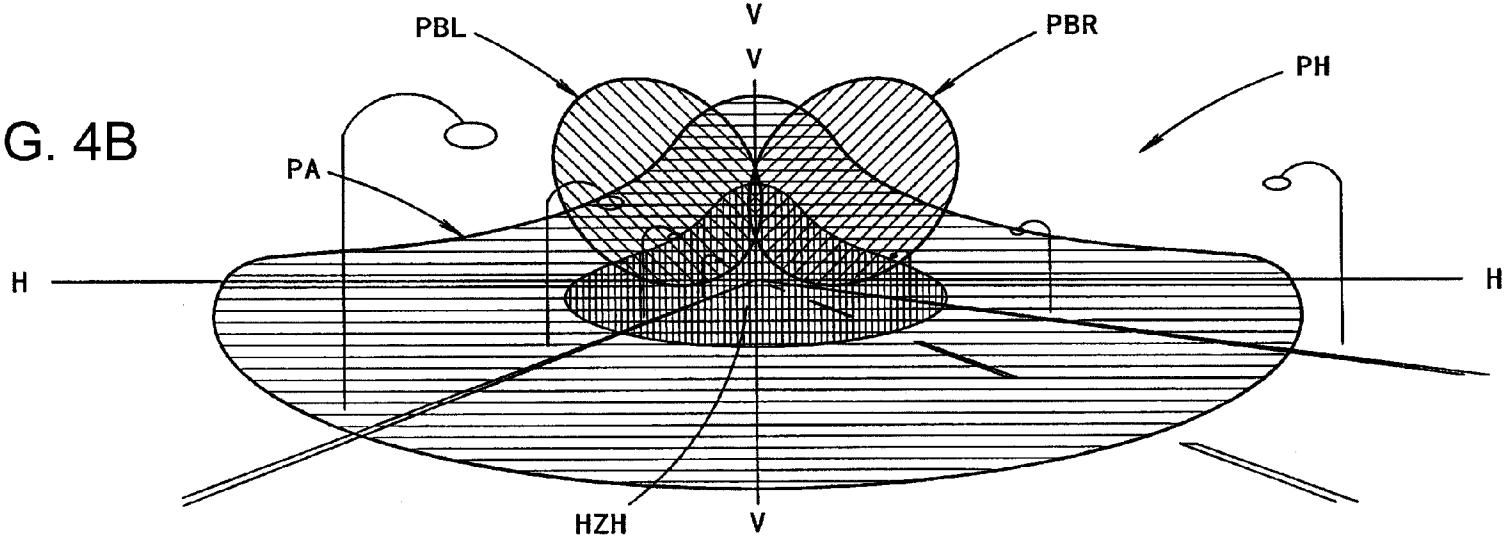

FIG. 4 shows diagrams perspectively showing light distribution patterns which are formed on the imaginary vertical screen disposed at a position 25 meters ahead of the headlamp, by light radiated forward from the vehicular headlamp 10, where FIG. 4(*a*) shows a low-beam distribution pattern PL, and FIG. 4(*b*) shows a high-beam distribution pattern PH.

The low-beam distribution pattern PL is a light distribution pattern, which is formed when the movable shade 20 is in the light-shielding position. The high-beam distribution pattern PH is a light distribution pattern, which is formed when the movable shade 20 is in the light-shielding moderating position.

The low-beam distribution pattern PL shown in FIG. 4(*a*) is a low-beam distribution pattern for left-side light distribution, and has laterally asymmetrical cut-off lines CL1, CL2 at its upper end edge. The cut-off lines CL1, CL2 extend in the horizontal direction in a laterally asymmetrical manner with respect to a line V-V that extends through a point H-V, i.e., a vanishing point in a forward direction of the lamp. A opposing lane side portion on the right side of the line V-V is formed as a lower step horizontal cut-off line CL1, while a driving lane side portion on the left side of the line V-V is formed as an upper step horizontal cut-off line CL2 which is stepped up from the lower step horizontal cut-off line CL1 via a tilted portion.

In the low-beam distribution pattern PL, an elbow point E, which is an intersection between the lower step horizontal cut-off line CL1 and the line V-V, is located about 0.5 to 0.6° below H-V. This is because the optical axis Ax of the lamp unit 20 extends downward by about 0.5 to 0.6° with respect to the vehicular longitudinal direction. Moreover, in this low-beam distribution pattern PL, a hot zone HZL, which is a high luminous intensity area, is formed so as to surround the elbow point E.

This low-beam distribution pattern PL is formed by projecting an image of the light source 12*a*, which is formed on the rear side focal plane of the projection lens 18 by light of the light source 12*a* reflected from the reflective surface 14*a* of the reflector 14, as an inverted projection image on the imaginary vertical screen by the projection lens 18. The cut-off lines CL1, CL2 thereof are formed as an inverted projection image of the upper end edge 20*a* of the movable shade 20.

Reflected light from the first reflection area 14*a*1 and the second reflection area 14*a*2 contributes to formation of the low-beam distribution pattern PL. However, reflected light from the pair of left and right lower reflection areas 14*a*L, 14*a*R is mostly blocked by the movable shade 20 located in the light-shielding position, and, thus, hardly contributes to formation of the low-beam distribution pattern PL.

On the other hand, the high-beam distribution pattern PH shown in FIG. 4(*b*) is formed as a synthesized light distribution pattern of a basic light distribution pattern PA, which is formed by reflected light from the first reflection area 14*a*1 and the second reflection area 14*a*2, and a pair of left and right additional light distribution patterns PBL, PBR, which are formed by reflected light from the pair of left and right lower reflection areas 14*a*L, 14*a*R.

The basic light distribution pattern PA is formed so as to spread upward to some extent from the cut-off lines CL1, CL2, with respect to the low-beam distribution pattern PL, and has a hot zone HZH in the proximity of H-V.

In this case, in order to increase the central luminous intensity of the hot zone HZH, the high-beam distribution pattern PH is a distribution pattern in which light is condensed towards the line V-V in a region above a line H-H extending through H-V in the horizontal direction. The high-beam distribution pattern PH becomes such a light distribution pattern in which light is condensed towards the line V-V in the region above the line H-H, because the deflection angle of the reflected light of the light source 12*a* towards the optical axis Ax in the horizontal cross section is set to a relatively large value for the second reflection area 14*a*2.

The pair of left and right additional light distribution patterns PBL, PBR are formed above both left and right sides of the hot zone HZH, respectively, so as to partially overlap the hot zone HZH.

In this case, the left additional light distribution pattern PBL is a light distribution pattern formed by reflected light from the right lower reflection area 14*a*R, and has its lower end edge located in the proximity of the line H-H, and its right end edge located in the proximity of the line V-V. On the other hand, the right additional light distribution pattern PBR is a light distribution pattern formed by reflected light from the left lower reflection area 14*a*L, and has its lower end edge located in the proximity of the line H-H, and its left end edge located in the proximity of the line V-V.

The left additional light distribution pattern PBL is formed on the left side of the line V-V because the right lower reflection area 14*a*R is formed so as to converge light from the light source 12*a* at a position located forward of the rear side focal point F of the projection lens 18 in the horizontal direction, and on the right side of the optical axis Ax (that is, the right lower reflection area 14*a*R is formed so as to cause the light from the light source 12*a* to pass through the rear side focal plane of the projection lens 18 at a position near the right side of the optical axis Ax). On the other hand, the right additional light distribution pattern PBR is formed on the right side of the line V-V because the left lower reflection area 14*a*L is formed so as to converge light from the light source 12*a* at a position located forward of the rear side focal point F of the projection lens 18 in the horizontal direction, and on the left side of the optical axis Ax (that is, the left lower reflection area 14*a*L is formed so as to cause the light from the light source 12*a* to pass through the rear side focal plane of the projection lens 18 at a position near the left side of the optical axis Ax).

Moreover, each of the pair of left and right additional light distribution patterns PBL, PBR is formed above the line H-H because the pair of left and right lower reflection areas 14*a*L, 14*a*R are formed so as to cause light from the light source 12*a* to pass through the rear side focal plane of the projection lens 18 at a position near under the optical axis Ax.

Thus, in the high-beam distribution pattern PH, the pair of left and right additional light distribution patterns PBL, PBR are formed on both sides of the hot zone HZH in an upper area of the basic light distribution pattern PA, respectively. As a result, an upper area of the high-beam distribution pattern PH becomes bright widely in the lateral direction, whereby forward visibility is improved.

As described in detail above, the vehicular headlamp 10 according to the present embodiment is constructed as a projector-type vehicular headlamp including the movable shade 20. The vehicular headlamp 10 can form the low-beam distribution pattern PL when the movable shade 20 is located in the light-shielding position, and can form the high-beam distribution pattern PL when the movable shade 20 is located in the light-shielding moderating position. In this case, each of the pair of lower reflection areas 14*a*L, 14*a*R, which are located on the left and right sides of the optical axis Ax in the lower end portion of the reflective surface 14*a* of the reflector 14, is formed so as to converge light from the light source 12*a* at a position located forward of the rear side focal point F of the projection lens 18 in the horizontal direction, and on the same lateral side as that of the lower reflection area 14*a*L, 14*a*R with respect to the optical axis Ax. Thus, the following effects can be obtained.

In other words, in the vehicular headlamp 10 of the present embodiment, the light source 12*a* is constructed as the line segment light source 12*a* extending generally coaxially with the optical axis Ax. Thus, an inverted projection image thereof is formed as an image radially extending on the imaginary vertical screen disposed ahead of a vehicle. Accordingly, if light is condensed in order to increase the central luminous intensity when forming a high-beam distribution pattern, the upper area of the high-beam distribution pattern PH becomes sufficiently bright in its lateral direction central portion, but becomes dark on both sides thereof, in the case where the pair of left and right lower reflection areas 14*a*L, 14*a*R are not formed. Thus, forward visibility cannot be improved.

In the vehicular headlamp 10 of the present embodiment, on the other hand, light of the light source 12*a*, reflected from each of the pair of left and right lower reflection areas 14*a*L, 14*a*R formed in the reflective surface 14*a* of the reflector 14, converges at a position located forward of the rear side focal point F of the projection lens 18 in the horizontal direction, and on the same lateral side as that of the lower reflection area 14*a*L, 14*a*R with respect to the optical axis Ax. Thus, the pair of left and right light ray bundles are emitted from the projection lens 18, whereby the pair of left and right additional light distribution patterns PBL, PBR are formed on both sides of the lateral direction central portion in the upper area of the high-beam distribution pattern PH, respectively. As a result, the upper area of the high-beam distribution pattern PH becomes bright widely in the lateral direction, whereby forward visibility is improved.

Thus, according to the present embodiment, forward visibility with a high beam of the projector-type vehicular headlamp 10 having a movable shade can be improved.

Moreover, light of the light source 12*a*, reflected on each of the pair of left and right lower reflection areas 14*a*L, 14*a*R, converges at a position located forward of the rear side focal point F of the projection lens 18 in the horizontal direction, and on the same lateral side as that of the lower reflection area 14*a*L, 14*a*R with respect to the optical axis Ax. Thus, most of the pair of left and right light ray bundles can be directed to the projection lens 18, even though the pair of left and right lower reflection areas 14*a*L, 14*a*R are located in the lower end portion of the reflective surface 14*a*.

Moreover, in the present embodiment, each of the pair of left and right lower reflection areas 14*a*L, 14*a*R is formed so as to cause light from the light source 12*a* to pass through the rear side focal plane of the projection lens 18 at a position near under the optical axis Ax. Thus, the pair of left and right additional light distribution patterns PBL, PBR can be made to substantially match the position of the upper area of the high-beam distribution pattern PH in the vertical direction. Thus, the effect of making the upper area of the high-beam distribution pattern PH bright widely in the lateral direction can be improved.

Moreover, in the present embodiment, the reflective surface 14*a* of the reflector 14 is divided into the upper first reflection area 14*a*1 and the lower second reflection area 14*a*2 along the horizontal plane including the optical axis Ax, and the upward stepped portion 14*d* is formed between the first reflection area 14*a*1 and the second reflection area 14*a*2. Thus, the first reflection area 14*a*1 can be formed mainly in order to form a light distribution pattern having a large lateral diffusion angle, which is suitable for a low-beam distribution pattern, and the second reflection area 14*a*2 can be formed mainly in order to increase the central luminous intensity of a high-beam distribution pattern.

Moreover, in the present embodiment, the lower end edge 14*e* of the second reflection area 14*a*2 in the reflective surface 14*a* of the reflector 14 is formed so as to extend in the horizontal direction. This facilitates manufacturing of the reflector 14, whereby the accuracy of the reflective surface 14*a* of the reflector 14 can be improved.

Note that, in the above embodiment, the vehicular headlamp 10 is constructed so as to form a low-beam distribution pattern for left-side light distribution as the low-beam distribution pattern PL. However, even when the vehicular headlamp 10 is constructed so as to form a low-beam distribution pattern for right-side light distribution as the low-beam distribution pattern PL, the same effects can be achieved using a similar structure to that of the above embodiment.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

10 VEHICULAR HEADLAMP
12 LIGHT SOURCE BULB
12*a* LIGHT SOURCE
14 REFLECTOR
14*a* REFLECTIVE SURFACE
14*a*1 FIRST REFLECTION AREA
14*a*2 SECOND REFLECTION AREA
14*a*L, 14*a*R LOWER REFLECTION AREA
14*b* OPENING
14*c* FITTING PORTION
14*d* STEPPED PORTION
14*e* LOWER END EDGE
16 HOLDER
18 PROJECTION LENS
20 MOVABLE SHADE
20*a* UPPER END EDGE
20*b* STAY
22 ACTUATOR
22*a* PLUNGER
24 PIVOT PIN
26 FIXED SHADE
26*a*, 26*b* POSITIONING CONTACT PORTION
Ax OPTICAL AXIS
CL1 LOWER STEP HORIZONTAL CUT-OFF LINE
CL2 UPPER STEP HORIZONTAL CUT-OFF LINE
E ELBOW POINT
F REAR SIDE FOCAL POINT
HZH, HZL HOT ZONE
PA BASIC LIGHT DISTRIBUTION PATTERN
PBL, PBR ADDITIONAL LIGHT DISTRIBUTION PATTERN
PH HIGH-BEAM DISTRIBUTION PATTERN
PL LOW-BEAM DISTRIBUTION PATTERN.

What is claimed is:

1. A vehicular headlamp comprising:
a projection lens disposed on an optical axis extending in a vehicular longitudinal direction;
a light source disposed rearward of a rear side focal point of the projection lens;
a reflector for reflecting light from the light source forward towards the optical axis;
a movable shade constructed so that the movable shade partially blocks the reflected light from the reflector; and
an actuator for moving the movable shade between:
a light-shielding position where an upper end edge of the movable shade is positioned in a proximity of the optical axis near the rear side focal point of the projection lens, and
a light-shielding moderating position where an amount of the reflected light from the reflector to be blocked is reduced as compared to the light-shielding position,
wherein the light source is constructed as a line segment light source extending generally coaxially with the optical axis;
wherein a pair of lower reflection areas are formed in a lower end portion of a reflective surface of the reflector so as to be positioned on both left and right sides of the optical axis, respectively; and
wherein each of the pair of left and right lower reflection areas is formed so as to converge the light from the light source:
at a position located forward of the rear side focal point of the projection lens in a horizontal direction, and
on the same lateral side as that of the each lower reflection area with respect to the optical axis.

2. The vehicular headlamp according to claim 1,
wherein each of the pair of left and right lower reflection areas is formed so as to cause the light from the light source to pass through a rear side focal plane of the projection lens at a position near under the optical axis.

3. The vehicular headlamp according to claim 2,
wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

4. The vehicular headlamp according to claim 2,
wherein a lower end edge of a reflection area other than the pair of left and right lower reflection areas in the reflective surface of the reflector is formed so as to extend in the horizontal direction.

5. The vehicular headlamp according to claim 4,
wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

6. The vehicular headlamp according to claim 1,
wherein a lower end edge of a reflection area other than the pair of left and right lower reflection areas in the reflective surface of the reflector is formed so as to extend in the horizontal direction.

7. The vehicular headlamp according to claim 6, wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

8. The vehicular headlamp according to claim 1, wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

9. A method of manufacturing a vehicular headlamp comprising:

disposing a projection lens on an optical axis extending in a vehicular longitudinal direction;

disposing a light source rearward of a rear side focal point of the projection lens;

disposing a reflector so as to reflect light from the light source forward towards the optical axis;

constructing a movable shade so that the movable shade partially blocks the reflected light from the reflector;

disposing an actuator so as to move the movable shade between:

a light-shielding position where an upper end edge of the movable shade is positioned in a proximity of the optical axis near the rear side focal point of the projection lens, and a light-shielding moderating position where an amount of the reflected light from the reflector to be blocked is reduced as compared to the light-shielding position, wherein the light source is constructed as a line segment light source extending generally coaxially with the optical axis;

forming a pair of lower reflection areas in a lower end portion of a reflective surface of the reflector so as to be positioned on both left and right sides of the optical axis, respectively; and forming each of the pair of left and right lower reflection areas so as to converge the light from the light source:

at a position located forward of the rear side focal point of the projection lens in a horizontal direction, and on the same lateral side as that of the each lower reflection area with respect to the optical axis.

10. The method according to claim 9 further comprising:

forming each of the pair of left and right lower reflection areas so as to cause the light from the light source to pass through a rear side focal plane of the projection lens at a position near under the optical axis.

11. The method according to claim 10, wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

12. The method according to claim 10 further comprising:

forming a lower end edge of a reflection area other than the pair of left and right lower reflection areas in the reflective surface of the reflector so as to extend in the horizontal direction.

13. The method according to claim 12, wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

14. The method according to claim 9 further comprising:

forming a lower end edge of a reflection area other than the pair of left and right lower reflection areas in the reflective surface of the reflector so as to extend in the horizontal direction.

15. The method according to claim 14, wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

16. The method according to claim 9, wherein, in a plane perpendicular to an optical axis of the lamp unit, light reflected from each of the pair of left and right lower reflection areas forms a light distribution pattern that substantially matches a position of an upper area of a high-beam distribution pattern in a vertical direction and causes the upper area of the high-beam distribution pattern to be brightened widely in a lateral direction.

* * * * *